US006629689B2

(12) United States Patent
Schauss

(10) Patent No.: US 6,629,689 B2
(45) Date of Patent: Oct. 7, 2003

(54) TOGGLE CLAMP CONSTRUCTION

(75) Inventor: Peter Schauss, Flörsheim (DE)

(73) Assignee: DE-STA-CO Metallerzeugnisse GmbH (DE)

( * ) Notice: Subject to any disclaimer, the term of this patent is extended or adjusted under 35 U.S.C. 154(b) by 19 days.

(21) Appl. No.: 09/833,725

(22) Filed: Apr. 12, 2001

(65) Prior Publication Data

US 2002/0149147 A1 Oct. 17, 2002

(51) Int. Cl.[7] ..... B25B 5/12
(52) U.S. Cl. ..... 269/228; 269/32
(58) Field of Search ..... 269/32, 24, 237, 269/20, 27, 30; 91/399, 400, 401

(56) References Cited

U.S. PATENT DOCUMENTS 3,682,327 A * 8/1972 Winne ..... 214/1
3,799,533 A * 3/1974 Malott ..... 269/32
5,163,663 A * 11/1992 Harris ..... 269/210
6,220,588 B1 * 4/2001 Tunkers ..... 269/32

FOREIGN PATENT DOCUMENTS

DE 2222686 6/1980
DE 19616441 12/1998

* cited by examiner

*Primary Examiner*—George Nguyen
*Assistant Examiner*—Daniel Shanley
(74) *Attorney, Agent, or Firm*—Webb Ziesenheim Logsdon Orkin & Hanson P.C.

(57) ABSTRACT

The invention is concerned with a toggle clamp construction comprising an actuator cylinder including a linearly guided piston rod. The piston rod engages a header of the construction arranged on one end or the actuator cylinder where it is connected, via an adjusting mechanism, to a clamp arm pivotally located on the header. The header is provided with at least one engaging hole; an extension is disposed an the piston rod. For selectively fixing the opening angle which is to be taken by the clamp arm after opening the clamp mechanism, a support element for a stop is detachably inserted in the engaging hole. The said stop protrudes into the path of adjustment of the extension of the piston rod, thereby determining the opening angle.

13 Claims, 4 Drawing Sheets

TOGGLE CLAMP CONSTRUCTION

BACKGROUND OF THE INVENTION

1. Field of the Invention

The present invention is concerned with toggle clamp constructions for clamping work pieces; in particular, its relates to such toggle clamps that are furnished with elements for confining the opening angle of the clamp arms of such mechanisms.

2. Description of the Prior Art

Clamp mechanism of the afore-described type have been disclosed, for example, by German Patent No. 136 16 441 C1 showing a so-called closed clamp head including an inquiry cassette adapted to be inserted in an engaging hole.

To confine the opening angle of the clamp arm of clamping mechanism of the afore-described type that can also consist of a clamp head opening in a fork-type way, German Patent Application No. 22 22 686 teaches to provide, within the end of the actuator cylinder facing away from the clamp head, a stop in the form of a pin serving as a path limiter for the piston moving during opening of the clamp mechanism toward the cylinder bottom, thereby defining the opening angle. The said pin can be axially adjusted by means of a bolt. Apart from the fact that such an adjustability by means of a bolt requires special sealing measures, the arrangement or assembly of such a stop means requires a special design at least of the bottom closure of the actuator cylinder, i.e. mass-produced or commercially available actuator cylinders cannot (readily) be used.

It is desirable that the clamp arm-opening angle of clap constructions of the afore-described type be adjustable because the opening angle of the clamp mechanism, for timing reasons, can be adjusted as large as necessary but as small as possible because in respect of timed finishing lines, for example, for the manufacture of car bodies or parts thereof, which is the principal field of application of clamping mechanisms of this type, the time required for opening and closing such a clamp mechanism is of decisive importance for the respective timed sequence.

OBJECTS AND SUMMARY OF THE INVENTION

It is, therefore, a primary object of the invention to so improve clamp mechanisms of the afore-described type that the adjustability of the limitation of the opening angle be insured independently of the actuator cylinder, and effected by means of a stop easily provided on the clamp head of the clamp construction in connection with the piston rod of the actuator cylinder.

A second object is to provide a new and improved clamp mechanism wherein the stop of the opening angle is to be adjustably arranged on the clamp head of the mechanism.

A third object of the invention is to provide a new and improved clamp construction wherein the opening position as reached is to be electrically displayed.

A further object of the invention is to provide a new and improved clamp mechanism wherein the gap or slot inherently provided on clamping mechanisms of this type be used on the clamp head to enable the stop to be accommodated therein.

The afore-going and other objects are attained with one aspect of the invention through a clamping mechanism comprising an actuator cylinder having a linearly guided piston rod in engagement with a header arranged on one end of the actuator cylinder, where it is connected, via an adjusting mechanism, to a clamp arm pivotally located on the header. In the area between the clamp arm and the actuator cylinder, the header includes an engaging hole, with an extension being provided on the piston rod of the actuator cylinder. In the practice of the invention, an element is detachably mounted in the engaging hole, which in cooperation with the extension of the piston rod forms a stop for limiting the opening angle of the clamp arm.

In the practice of the invention, the engaging hole anyway available in clamp assemblies of the afore-described type for the so-called end position inquiry cassette otherwise to be inserted therein, is used to insert therein and fix thereto, in lieu thereof, an element which together with the extension arranged on the piston rod of a correspondingly stable configuration, forms a stop for limiting the opening angle. Depending on the opening angle to be adjusted for the clamp arm, a correspondingly designed element is inserted into the engaging hole which defines the maximum path of displacement of the piston rod toward the pressure cylinder. A stock of elements designed in accordance with the path of displacement to be adjusted can be stored at the place of use of the clamp mechanism, to select therefrom the desired element in case of a switch-over of the clamp mechanism. However, by way of alternative it is preferred to provide an adjustable stop yet to be explained hereinafter.

BRIEF DESCRIPTION OF THE DRAWINGS

Various objects, features and attendant advantages of the present invention will be sore fully appreciated as the same becomes better understood from the following detailed description thereof, when considered in connection with the accompanying drawings, wherein.

DETAILED DESCRIPTION OF THE PREFERRED EMBODIMENTS

Figure 1:
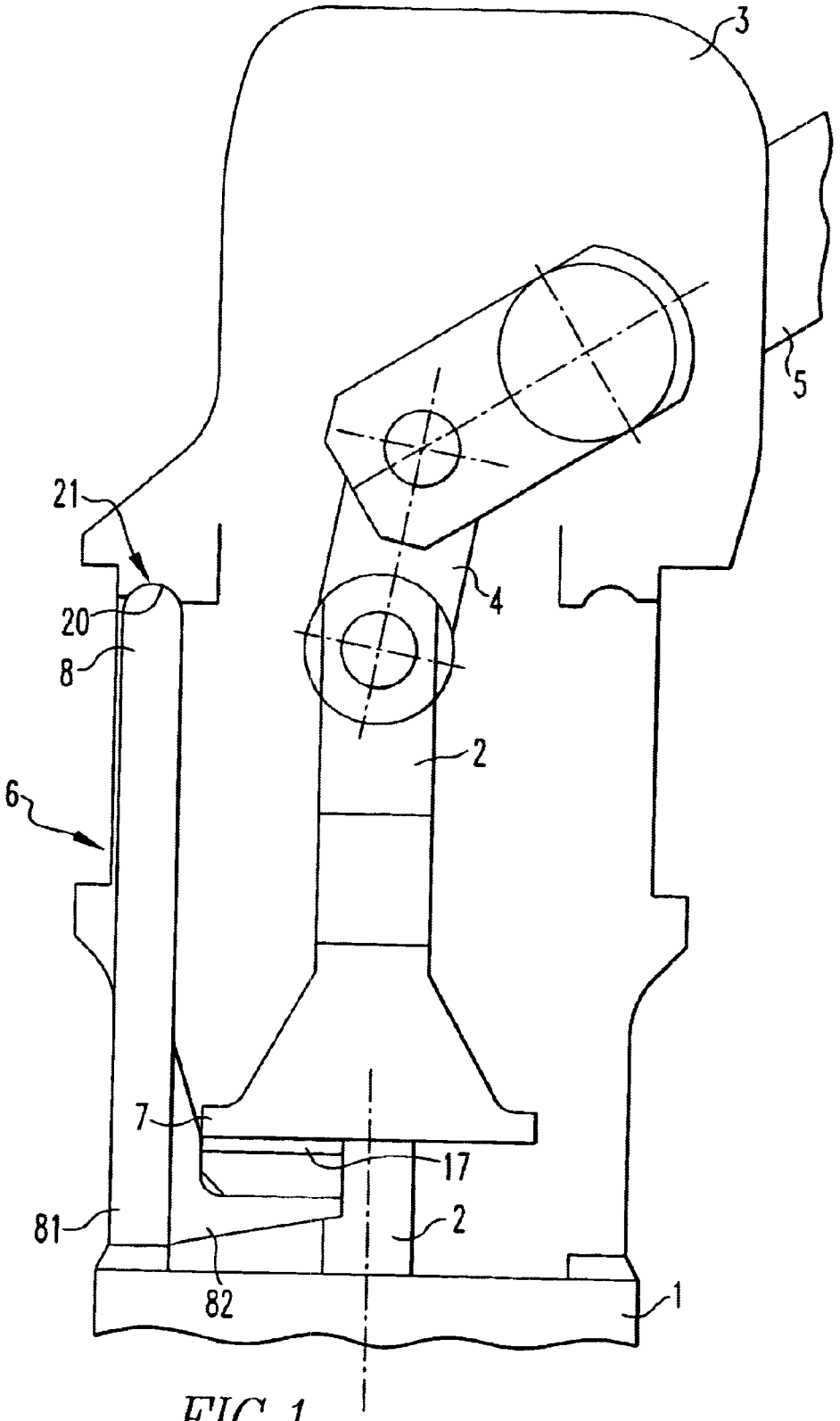
FIG. 1 shows schematically a side view of the clamping mechanism of the invention of the closed-housing type.

Referring to FIG. 1, the toggle clamp includes an actuator cylinder 1 comprising a linearly guided piston rod 2 in engagement with a header 3 of the construction, arranged on one end of the actuator cylinder 1, where it is connected, via a link element 4, to a clams arm 5 pivotally disposed on the header 3, The said header 3, in the area between the clamp arm 5 and the actuator cylinder 1, is provided with an engaging hole 6. Arranged on the piston rod 2 is an extension 7. Detachably mounted in the said engaging hole 6 of the header 3 is a support element 8 extending in parallel to the piston rod 2. Arranged on the support element 8, in the bottom end area thereof, is a stop 82 which, for limiting the opening angle of the clamp arm 5, protrudes into the path of adjustment of the extension 7 arranged on the piston rod 2.

Figure 3:
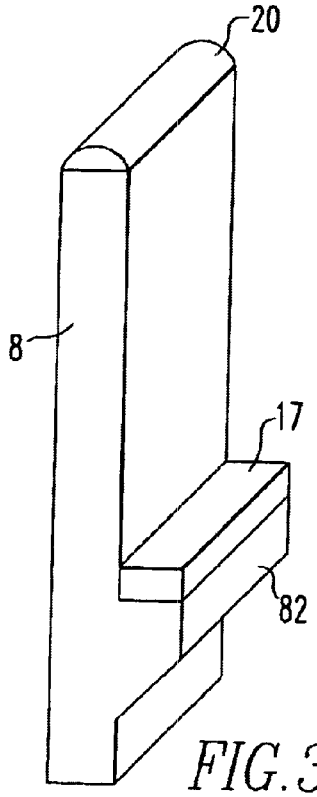
FIG. 3 is a perspective view of an alternative form of embodiment of the element to be inserted into the engaging hole.
Figure 4:
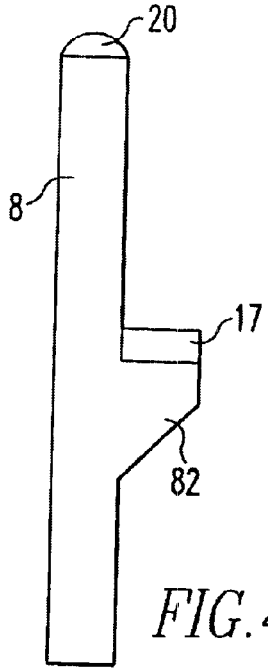
FIG. 4 is a side view of an alternative form of embodiment of the element of FIG. 3.

If the stop 82 forms an integral unit with the support element 8 as shown, for example, in FIGS. 3, 4, one or the other of said support elements 8 is respectively inserted into the header 3, depending on the desired opening angle, with the support element 8 with stop 82 thereof leading to a larger opening angle of the clamp arm 5 than the support element shown in FIG. 4.

However, an embodiment wherein the stop 82 can he fixed to the support element 8 in varying positions of vertical height is to be preferred, which will he explained hereinafter in greater detail.

In order to enable the support element to be easily inserted into header 3, support element 8 on one end thereof is provided with an arcuate radius 20 (see FIG. 1) inserted into a conforming negative arcuate radius 21 on the header 3, while the other end 81 is detachably fixed to the header, with the said fixation being effected, for example, by a bolt not shown in any detail.

Figure 5:
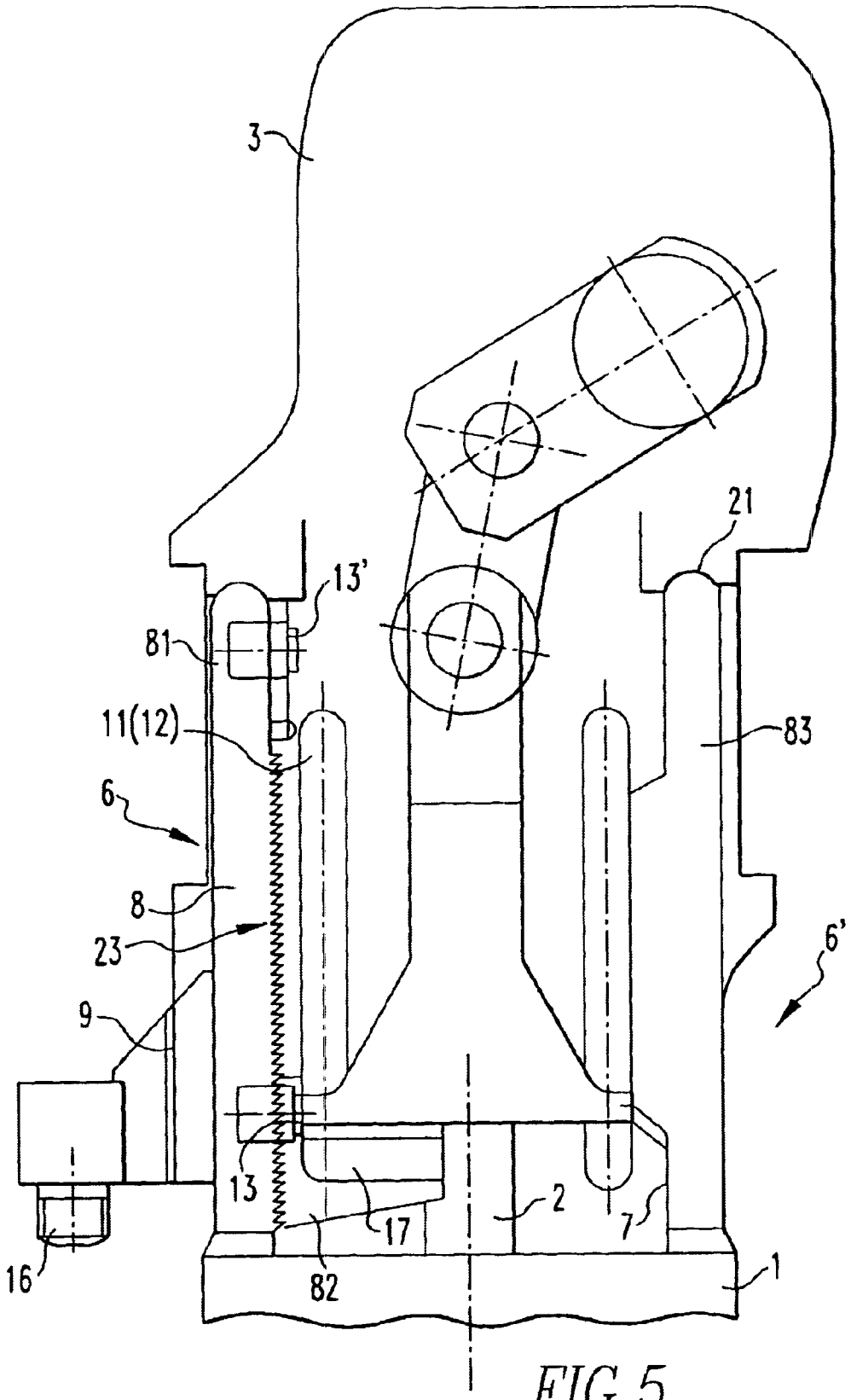
FIG. 5 is a sectional side view of the clamping mechanism having a closed header, and of a preferred form of embodiment of the element comprising inquiry means.

To exclude, as mentioned before, the need for a plurality of support elements 8 with differently associated stops 82, the form of embodiment as shown in FIG. 5 is the preferred one, wherein the support element 8, on the side facing the piston rod, is provided with a toothing 23 engaged by stop 82 provided with a conforming toothing.

To enable an attenuated mounting of the extension 7 on the stop, preferably a pad 17 is arranged on the stop for attenuating purposes. Conversely, a pad 171 can be arranged underneath extension 7, attaining the same effect (see FIG. 1).

To enable the two end positions of the clamp arm 5 to be electrically inquired, a sensor 13' sensing the clamping position and a sensor 13 sensing the opening position, are arranged on the support element 8 in a space-adjustable way.

With such sensor means being disposed on the mechanism, the sensor 13 sensing the opening position, preferably, is arranged adjustably on the stop 82 provided on the support element. Hence, when adjusting the stop 82 the sensor 13 sensing the opening position automatically is also adjusted.

Figure 6:
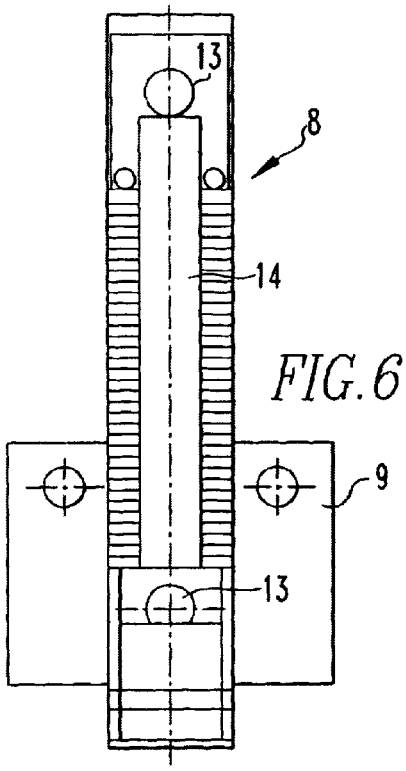
FIG. 6 is a front view of the element according to FIG. 5.
Figure 7:
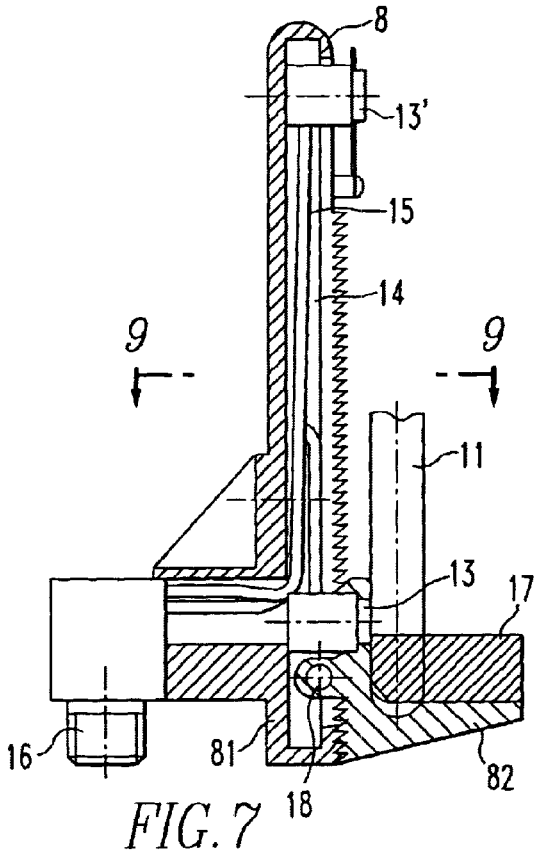
FIG. 7 is a sectional side view of the element of FIG. 5.
Figure 8:
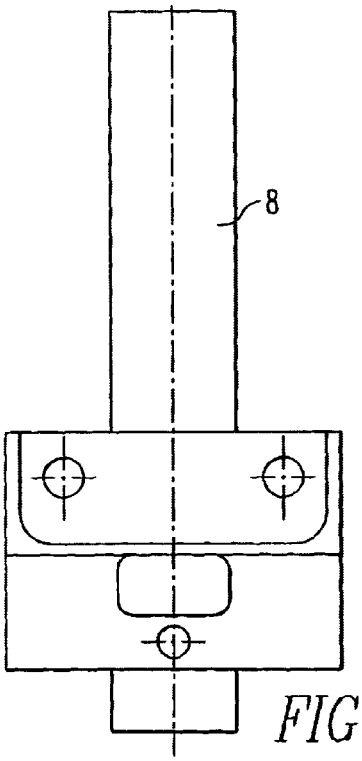
FIG. 8 is a rear view of the element according to FIG. 5.

Referring to FIGS. 6 and 7, the support element 8, on the part facing the piston rod, is provided with a groove 14 for accommodating cables 15 leading to sensors 13, 13', with the said cables 15 coming out of a cable connection 16 arranged on the outer side of the support element 8.

Figure 2:
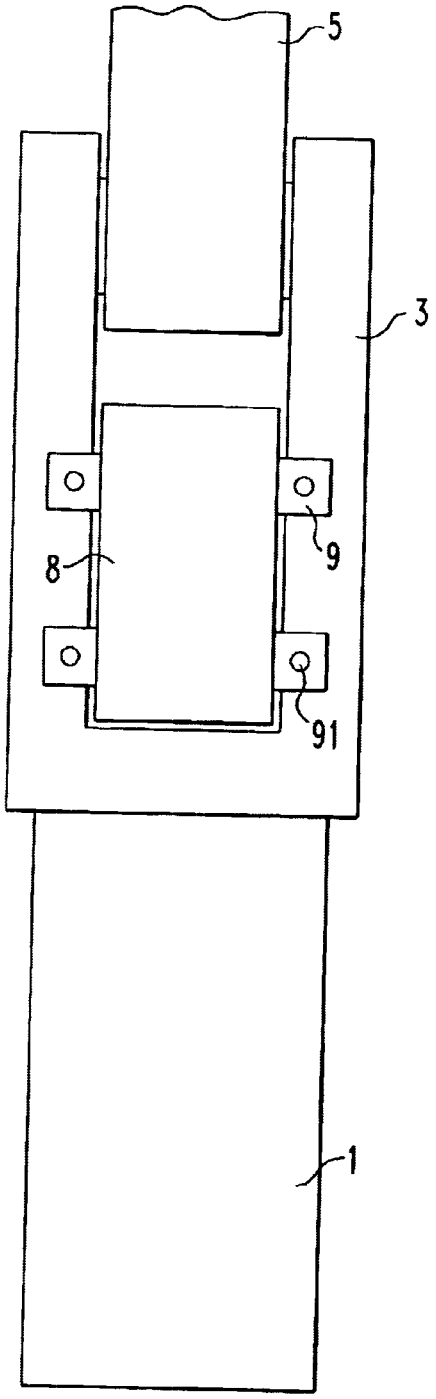
FIG. 2 shows schematically a rear view of the clamping mechanism comprising a fork-type header.

Apart from the afore-mentioned simple bolting of the bottom end 81 of the support element 8 to the header, the support element 8 is provided with at least one latch 9 laterally protruding beyond the engaging hole 6 and together with the said latch 9 being detachably fixed to header 3 by means of bolts 91. The schematical illustration according to FIG. 2 shows four latches 9 at this type, whereas the one according to FIGS. 6, 7 shows two latches 9.

Figure 9:
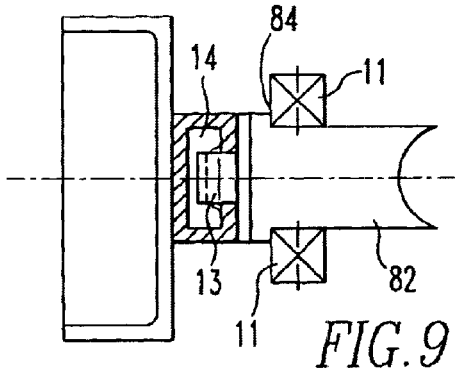
FIG. 9 is a sectional view of the element of FIG. 5 taken along the line A—A in FIG. 7.

To enable the stop 82 pivotally associated to the support element 8, on the one hand, to be easily displaced on the support element 8 and to be adjusted to the desired height, respectively, and, on the other hand, to take into account the torque load when the extension 7 is mounted on the stop 82, at least one groove 10 is provided in the header 3 at least an one side in parallel to the piston rod 2, which groove 10 is engaged by a guide element arranged on the stop 82. To that effect, reference is made to FIGS. 7 and 9 and also to FIG. 5, showing two such grooves 10 sunk within an internal flank of the said header 3. Through the guide elements 11 engaging the grooves laterally firmly seated on the stop 82, the stop 82 is safely guided in such a way that the latter can be held on the support element 8 in an easily detachable manner simply by means of a ball pawl 18.

Referring to FIG. 5 preferably the header 3, opposite the engaging hole 6, is furnished with a conforming hole 6' in order to insert the support element 8 with the stop 82 thereof on both sides of the header 3, i.e. on one or on the other side thereof, depending on the requirement. Inserted in the non-used engaging hole is a closure 83 (see FIG. 5) conforming in shape and size to the support element 8 which, however, has no stop 82.

What I claim is as follows:

1. A toggle clamp construction comprising an actuator cylinder provided with a linearly guided piston rod, wherein:

the piston rod engages a header arranged on one end of the actuator cylinder where the piston rod is connected via a link to a clamp arm pivotally disposed on the header, the header, includes an engaging hole in an area between the clamp arm and the actuator cylinder, with an extension arranged on the piston rod, a support element is detachably arranged in the engaging hole of the header, with the support element extending in parallel to the piston rod, and a stop disposed on the support element at a bottom end thereof, with the stop protruding, for limiting the opening angle of the clamp arm, into a path of adjustment of the extension arranged on the piston rod.

2. The toggle clamp according to claim 1, wherein the stop can be fixed to the support element in different positions of vertical height.

3. The toggle clamp according to claim 1, wherein the support element at one end thereof is provided with an arcuate radius inserted in a conforming negative arcuate radius provided on the header, and at the other end is detachably fixed to the header.

4. The toggle clamp according to claim 2, wherein the support element on the side facing the piston rod, is provided with a toothing engaged by the stop provided with a conforming toothing.

5. The toggle clamp according to claim 1, further including a pad arranged on the stop for attenuating purposes.

6. The toggle clamp according to claim 1, further including a pad provided underneath the extension for attenuating purposes.

7. The toggle clamp according to claim 1, further including a first sensor sensing the clamping position and a second sensor sensing the opening position, with the sensors provided on the support member in a space-adjustable manner.

8. The toggle clamp according to claim 7, wherein the second sensor sensing the opening position is arranged on the stop adjustably disposed on the support element.

9. The toggle clamp according to claim 8, wherein the support element, on the side facing the piston rod, is provided with a groove for accommodating cables leading to the sensors.

10. The toggle clamp according to claim 9, wherein the support element, on the outer side thereof, is provided with a cable connection.

11. The toggle clamp according to claim 1, wherein the support element is provided with at least one latch protruding beyond the engaging hole, and the support element and the latch are detachably fixed to the header.

12. The toggle clamp according to claim 1, further including a groove disposed within the header at least on one side thereof and parallel to the piston rod, with the groove engaged by a guide element arranged on the stop.

13. The toggle clamp according to claim 1, wherein the header includes a conforming engaging hole opposite the engaging hole.

* * * * *

UNITED STATES PATENT AND TRADEMARK OFFICE

CERTIFICATE OF CORRECTION

PATENT NO. : 6,629,689 B2
DATED : October 7, 2003
INVENTOR(S) : Peter Schauss

It is certified that error appears in the above-identified patent and that said Letters Patent is hereby corrected as shown below:

Title page,
Item [57], ABSTRACT,
Line 7, “disposed an” should read -- disposed on --.

Column 1,
Line 13, “136 16 441” should read -- 196 16 441 --.
Line 31, “clap” should read -- clamp --.

Column 2,
Line 26, “sore” should read -- more --.
Line 49, “A-A” should read -- 9-9 --.
Line 56, “clams” should read -- clamp --.

Column 3,
Line 24, “pad 171” should read -- pad 17 --.

Signed and Sealed this

Thirteenth Day of April, 2004

JON W. DUDAS
*Acting Director of the United States Patent and Trademark Office*